US009487906B2

(12) United States Patent
Hong et al.

(10) Patent No.: US 9,487,906 B2
(45) Date of Patent: Nov. 8, 2016

(54) LAUNDRY MACHINE AND METHOD FOR CLEANING LINT FILTER OF LAUNDRY MACHINE

(75) Inventors: Sangwook Hong, Seoul (KR); Cheolsoo Ko, Seoul (KR); Hyojun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 562 days.

(21) Appl. No.: 13/985,519

(22) PCT Filed: Apr. 5, 2012

(86) PCT No.: PCT/KR2012/002558

§ 371 (c)(1),
(2), (4) Date: Aug. 14, 2013

(87) PCT Pub. No.: WO2012/138136

PCT Pub. Date: Oct. 11, 2012

(65) Prior Publication Data

US 2013/0318813 A1 Dec. 5, 2013

(30) Foreign Application Priority Data

Apr. 5, 2011 (KR) ..... 10-2011-0031033
Apr. 18, 2011 (KR) ..... 10-2011-0035629

(51) Int. Cl.
*F26B 7/00* (2006.01)
*D06F 39/10* (2006.01)
(Continued)

(52) U.S. Cl.
CPC ..... *D06F 39/10* (2013.01); *D06F 25/00* (2013.01); *D06F 39/088* (2013.01); *D06F 58/22* (2013.01); *D06F 37/22* (2013.01)

(58) Field of Classification Search
CPC ..... D06F 25/00; D06F 39/088; D06F 58/22; D06F 39/10; D06F 37/22
USPC ..... 34/380
See application file for complete search history.

(56) References Cited

U.S. PATENT DOCUMENTS

2004/0221474 A1* 11/2004 Slutsky ..... D06F 25/00 34/319
2005/0252029 A1* 11/2005 Kim ..... D06F 25/00 34/596

(Continued)

FOREIGN PATENT DOCUMENTS

CN 1757814 A 4/2006
CN 1786328 A 6/2006

(Continued)

OTHER PUBLICATIONS

European Office Action dated Jun. 9, 2015 issued in Application No. 12767662.5.

(Continued)

*Primary Examiner* — Kenneth Rinehart
*Assistant Examiner* — Bao D Nguyen
(74) *Attorney, Agent, or Firm* — KED & Associates, LLP

(57) ABSTRACT

The present invention relates to a laundry machine in which the lint filter can be cleaned even at low water pressure and a method for cleaning the lint filter, wherein the invention comprises: a tub in which washing water is accommodated; a drum which is rotatably disposed in said tub; an air circulating unit which supplies air to said tub; an air returning hole which returns the air of said tub to said air circulating unit; a lint filter which filters lint contained in the air which is circulated by said air circulating unit; and a filter cleaning unit which sprays the washing water through a plurality of nozzle holes such that said lint is separated from said lint filter.

3 Claims, 15 Drawing Sheets

(51) Int. Cl.

| | |
|---|---|
| ***D06F 25/00*** | (2006.01) |
| ***D06F 39/08*** | (2006.01) |
| ***D06F 58/22*** | (2006.01) |
| *D06F 37/22* | (2006.01) |

(56) References Cited

U.S. PATENT DOCUMENTS

| | | | | |
|---|---|---|---|---|
| 2006/0075577 | A1* | 4/2006 | Jeong | D06F 25/00 8/158 |
| 2006/0080787 | A1 | 4/2006 | Choi | |
| 2006/0123854 | A1* | 6/2006 | Hong | D06F 25/00 68/19.1 |
| 2010/0154240 | A1 | 6/2010 | Grunert | 34/82 |
| 2010/0192398 | A1* | 8/2010 | Ahn | D06F 58/206 34/79 |

FOREIGN PATENT DOCUMENTS

| | | | |
|---|---|---|---|
| EP | 1 669 487 | A1 | 6/2006 |
| EP | 2 202 349 | A2 | 6/2010 |
| JP | 2004-261324 | A | 9/2004 |
| JP | 2006-187449 | A | 7/2006 |
| JP | 2009-142351 | A | 7/2009 |
| KR | 20-0273196 | Y1 | 4/2002 |
| KR | 10-2007-0059419 | A | 6/2007 |
| KR | 10-2010-0129242 | A | 12/2010 |
| WO | WO 2009/015919 | A1 | 2/2009 |

OTHER PUBLICATIONS

European Search Report dated Aug. 7, 2014 issued in Application No. 12 767 662.5.

International Search Report dated Oct. 29, 2012 issued in Application No. PCT/KR2012/002558 (with English translation).

* cited by examiner

B-B'

LAUNDRY MACHINE AND METHOD FOR CLEANING LINT FILTER OF LAUNDRY MACHINE

CROSS-REFERENCE TO RELATED PATENT APPLICATIONS

This application is a U.S. National Stage Application under 35 U.S.C. §371 of PCT Application No. PCT/KR2012/002558, filed Apr. 5, 2012, which claims priority to Korean Patent Application Nos. 10-2011-0031033, filed Apr. 5, 2011, and 10-2011-0035629, filed Apr. 18, 2011.

TECHNICAL FIELD

The present invention relates to a laundry machine and a method of cleaning a lint filter of the laundry machine, and more particularly to a laundry machine in which a lint filter may be cleaned even when supplied with water at a low pressure and a method of cleaning the lint filter of the laundry machine.

BACKGROUND ART

In general, a laundry machine is a product that removes a variety of contaminants adhered to clothes, bedclothes, etc. using emulsification, friction of a water stream caused by rotation of a pulsator or drum, and shock applied to laundry, for example. Recently launched fully automatic laundry machines automatically perform a series of processes in the sequence of, a washing course, a rinsing course, and a dehydration course, for example, without user manipulation.

In addition, a laundry machine with a drying function is one kind of laundry machine that may not only perform the aforementioned washing function, but also dry washed laundry. One example of the laundry machine with a drying function is a condensation type washing and drying machine in which air discharged from a tub is sequentially subjected to condensation, moisture removal, and heating, and then is returned into the tub.

Hereinafter, a conventional condensation type laundry machine with a drying function will be described in brief with reference to the accompanying drawing. FIG. 1 is a schematic view showing a conventional laundry machine.

As exemplarily shown in FIG. 1, the laundry machine with a drying function 10 includes a cabinet 11 internally defining an accommodation space, a tub 12 accommodated in the cabinet 11, a drum 13 rotatably disposed in the tub 12, a condensation duct 14 connected to the exterior of the tub 12, in which condensation of humid air discharged from the tub 12 occurs, a heating duct 15 connected to a downstream end of the condensation duct 14 in an air flow direction, in which the air is heated by a heater 16 and is introduced into the tub 12, and a blower fan 17 to circulate the air of the tub 12 through the condensation duct 14 and the heating duct 15.

The laundry machine with a drying function 10 as described above functions to dry laundry using rotation of the drum 13 as well as hot air that is generated as the air circulated by the blower fan 17 is heated by the heater 16 provided in the heating duct 15 and the heated air is supplied into the tub 12.

Thereafter, the heated air, used to dry laundry, becomes humid as the laundry is dried, and is discharged from the tub 12 into the condensation duct 14 such that moisture contained in the air is removed in the condensation duct 14. Here, to condense the humid air within the condensation duct 14, cold water is supplied into the condensation duct 14.

Meanwhile, the air introduced into the condensation duct 14 is resupplied into the heating duct 15 by the blower fan 17, and the aforementioned proceeds continuously such that the air is continuously circulated.

Meanwhile, the aforementioned condensation duct 14 takes the form of a pipe in consideration of the blowing capacity of the blower fan 17 and efficient air movement. The condensation duct 14 removes moisture contained in the humid air by condensing the moisture via heat exchange between the humid air and an inner surface of the condensation duct 14. To condense the moisture of the humid air introduced into the condensation duct 14 in the aforementioned manner, it may be necessary to continuously supply a great quantity of cold water during drying of laundry.

However, the area of the condensation duct 14 for heat exchange with the humid air has conventionally been very small, and requires a relatively great quantity of cold air for a long time, which may cause waste of the cold water.

In addition, during drying of laundry, lint contained in the laundry may be moved, along with air, through the condensation duct 14, thus remaining in the condensation duct 14, the blower fan 17, the heating duct 15, etc. The lint remaining in the condensation duct 14 may reduce efficiency of the condensation duct 14, the lint remaining in the blower fan 17 may cause breakdown of the blower fan 17, and the lint remaining in the heating duct 15 may cause breakdown or fire of the heater 16 disposed in the heating duct 15.

Therefore, a lint filter to filter the lint contained in hot air to be introduced into the condensation duct 14 may be required, and maintenance/repair management of the lint filter must thus be frequently performed.

DISCLOSURE

Technical Problem

Accordingly, the present invention is devised to solve the aforementioned problems, and one object of the present invention is to provide a laundry machine having an improved condensation configuration to remove moisture of hot air used to dry laundry, thereby achieving enhanced condensation efficiency.

Further, the present invention is devised to solve the aforementioned problems, and another object of the present invention is to provide a laundry machine having an improved maintenance/repair configuration of a lint filter to filter lint contained in hot air.

Furthermore, the present invention is devised to solve the aforementioned problems, and a further object of the present invention is to provide a laundry machine having an improved cleaning configuration of a lint filter to ensure efficient cleaning of the lint filter if the pressure of wash water supplied into the laundry machine is less than a preset pressure and a method of cleaning the lint filter of the laundry machine.

Technical Solution

To achieve these objects and other advantages and in accordance with the purpose of the invention, as embodied and broadly described herein, a laundry machine includes a tub in which wash water is accommodated, a drum rotatably provided in the tub, an air circulation unit configured to supply air into the tub, an air return port configured to return the air of the tub to the air circulation unit, a lint filter configured to filter lint contained in the air circulated by the air circulation unit, and a filter cleaning unit configured to eject wash water through a plurality of nozzle holes so as to separate the lint from the lint filter.

The laundry machine may further include a wash water line configured to supply the wash water, the wash water line being separated from a supply path of the wash water.

The air return port may be formed in a tangential direction of an outer circumferential surface of the tub.

The lint filter may be formed on an extension plane of the outer circumferential surface of the tub.

The filter cleaning unit may be configured to eject the wash water toward the lint filter inward of the tub from the outside of the tub.

The filter cleaning unit may include a wash water line configured to supply the wash water, and a distribution nozzle configured to eject the wash water, supplied from the wash water line, to the lint filter through the plurality of nozzle holes.

The distribution nozzle may include a body part connected to the wash water line, and a distribution part connected to the body part, the distribution part being provided with the plurality of nozzle holes having different ejection angles respectively.

The distribution part may have a hollow shape internally defining a bore, one end of which is closed and the other end of which is open for movement of the wash water, and the plurality of nozzle holes may be configured to have different ejection angles about the center of the distribution part.

The plurality of nozzle holes may be symmetrically formed about a longitudinal direction of the distribution part.

The plurality of nozzle holes may be divided by a plurality of ejection regions that is defined to have a constant area in the longitudinal direction of the distribution part.

In accordance with another aspect of the present invention, a method of washing a lint filter of a laundry machine, wherein the laundry machine includes a wash water line configured to supply wash water, a wash water valve configured to open or close the wash water line, and a filter washing unit configured to eject the wash water to the lint filter so as to clean the lint filter, includes a washing stroke including intermittent supply of the wash water under control of the wash water valve.

The washing stroke may be performed before a rinsing stroke or a drying stroke of the laundry machine.

The drying stroke may include sensing the amount of laundry, preliminarily drying the laundry by supplying hot air in a state in which the laundry is stationary, dehydrating the laundry, drying the laundry by supplying hot air while moving the laundry, and drying the laundry by supplying cold air while moving the laundry.

The washing stroke may be performed before the sensing of the amount of laundry, or between the hot air drying and the cold air drying.

The intermittent supply of wash water may include intermittently ejecting the wash water for 1 to 2 seconds at an interval of 1 to 2 seconds.

Advantageous Effects

According to a laundry machine of the present invention, a condensation configuration to remove moisture of hot air used to dry laundry is improved, which results in enhanced condensation efficiency of moisture contained in hot air.

Further, according to the laundry machine of the present invention, a filter cleaning configuration for maintenance and repair of a lint filter used to filter lint contained in hot air is provided, which ensures easy cleaning of the lint filter.

Furthermore, according to the laundry machine and a method of washing the lint filter of the laundry machine of the present invention, even in the case in which the pressure of wash water supplied into the laundry machine is less than a preset pressure, efficient cleaning of the lint filter may be accomplished.

BEST MODE

Hereinafter, the embodiments of the present invention will be described in detail. In the description of the present invention, names of respective constituent elements are defined into consideration the functions obtained in accordance with the present invention. Accordingly, the names should not be construed as limiting the respective constituent elements of the present invention. In addition, the names of the respective constituent elements may be replaced with other names known in the art.

First, a laundry machine according to one embodiment of the present invention will be described in detail with reference to the accompanying drawings.

Figure 1:
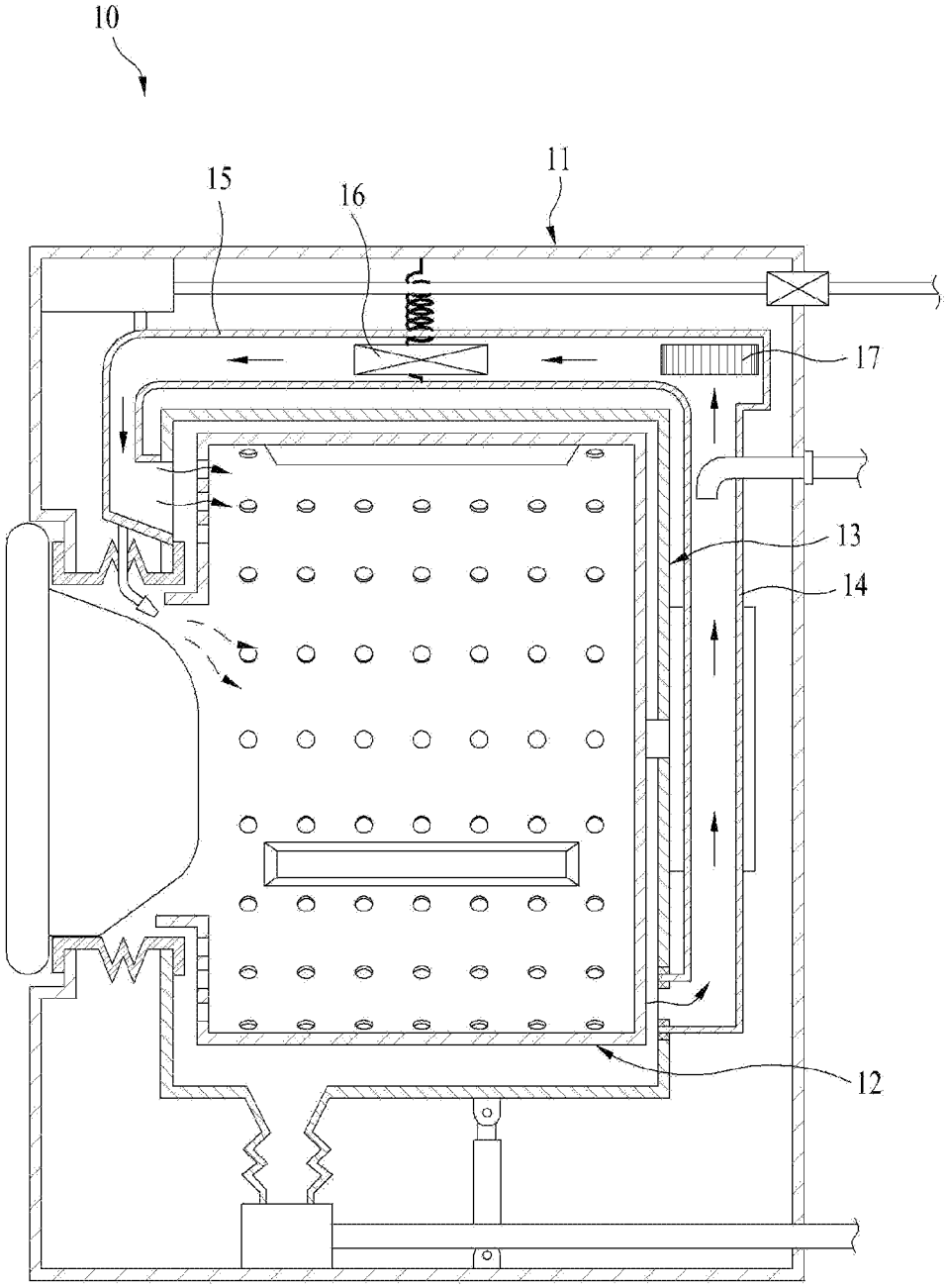
FIG. 1 is a schematic view showing a conventional laundry machine.
Figure 2:
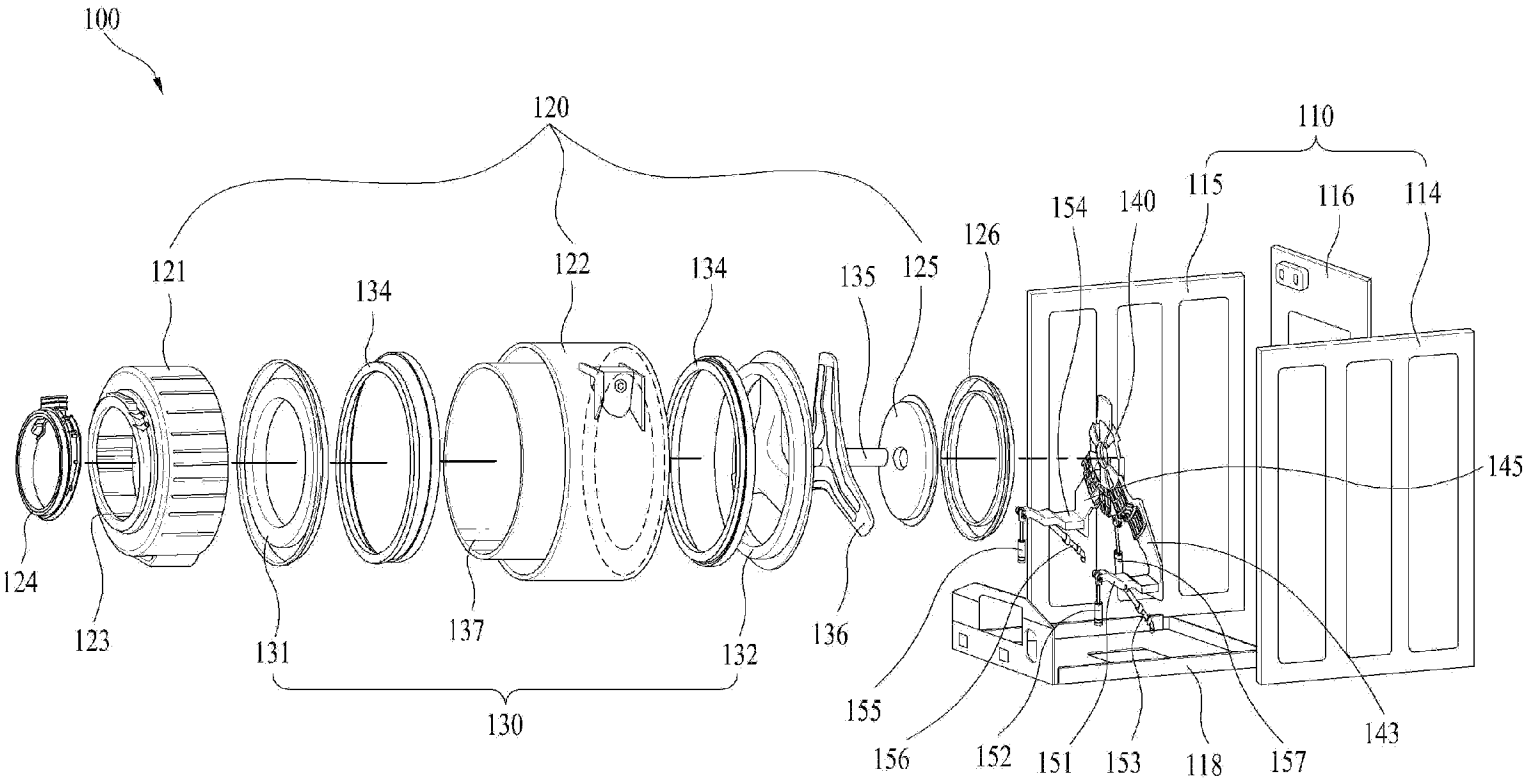
FIG. 2 is an exploded perspective view showing a laundry machine according to the present invention.
Figure 3:
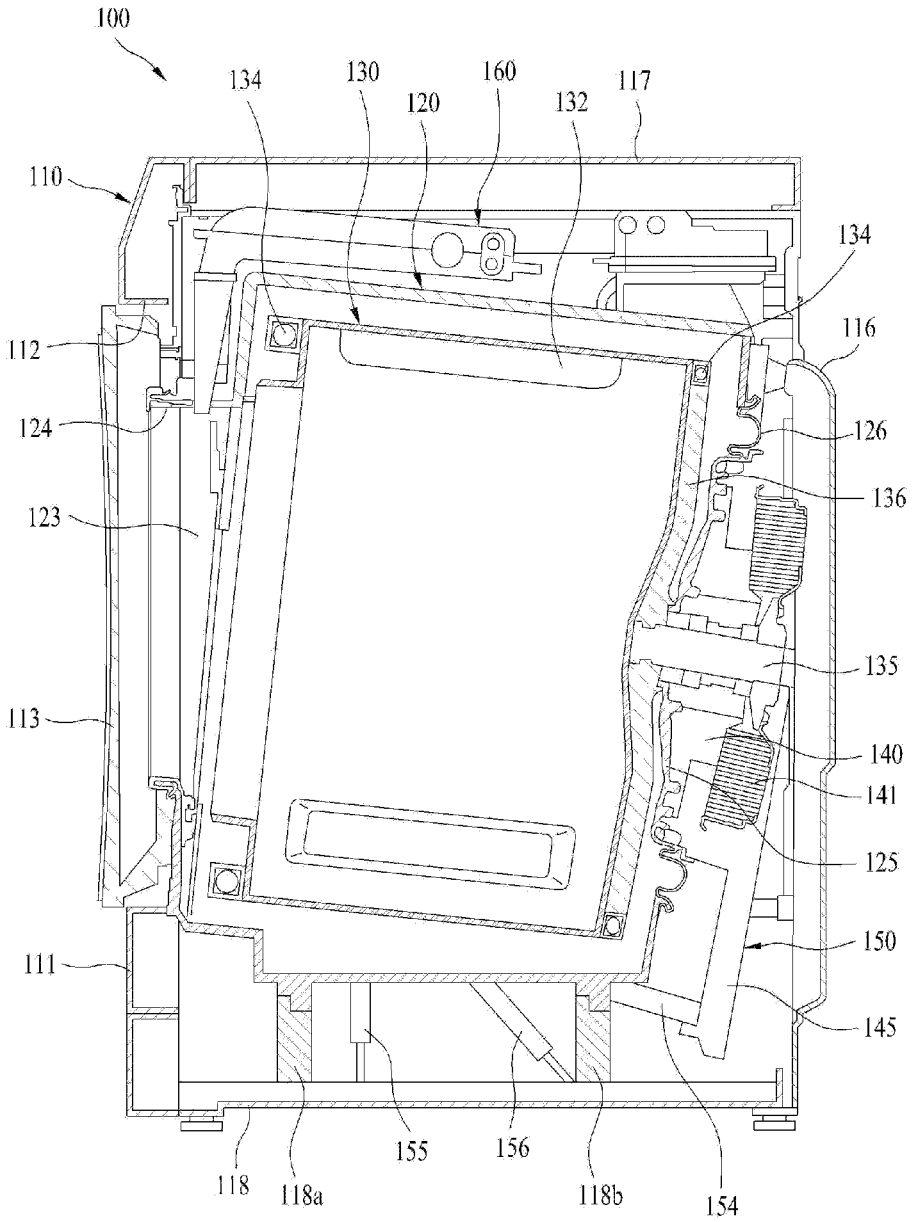
FIG. 3 is a sectional view showing an internal configuration of the laundry machine according to the present invention.
Figure 4:
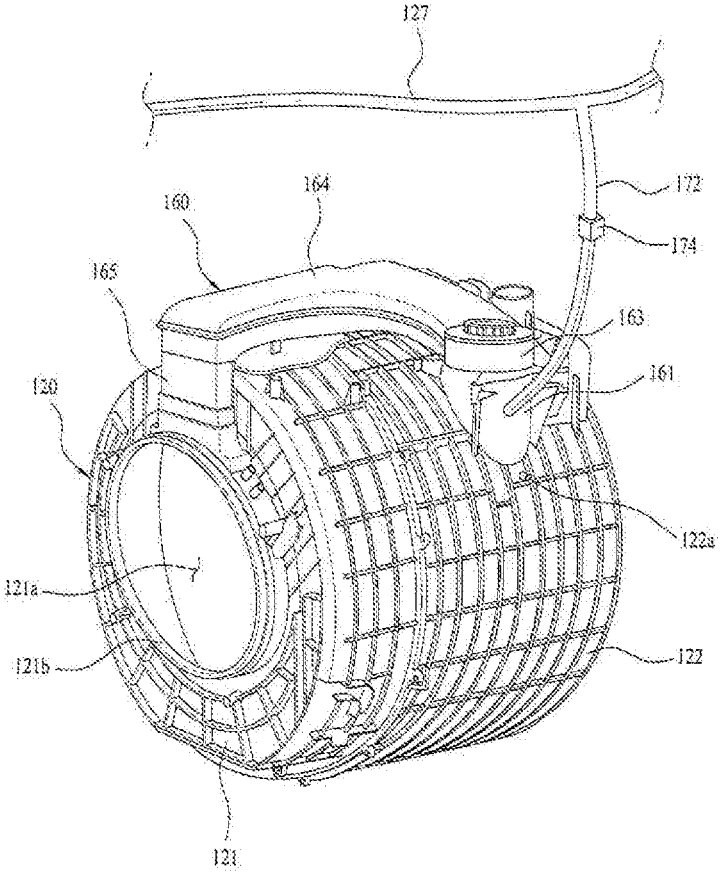
FIG. 4 is a perspective view showing a drying module and a tub of the laundry machine according to the present invention.

FIG. 2 is an exploded perspective view showing a laundry machine according to the present invention, FIG. 3 is a sectional view showing an internal configuration of the laundry machine according to the present invention, and FIG. 4 is a perspective view showing a drying module and a tub of the laundry machine according to the present invention.

As exemplarily shown in FIGS. 2 and 3, the laundry machine 100 according to the present invention includes a cabinet 110 defining an external appearance of the laundry machine 100, a tub 120 fixedly installed in and supported by the cabinet 110, a drum 130 rotatably disposed in the tub 120, a rotating shaft 135 penetrating a back wall of the tub 120 and connected to the drum 130, a bearing housing 140 to support the rotating shaft 135, a drive motor 141 provided at the bearing housing 140 to transmit rotary power to the rotating shaft 135, and a suspension unit 150 coupled to the bearing housing 140 to support structures connected to the bearing housing 140 and absorb vibration and/or shock. In addition, the laundry machine 100 according to the present invention includes an air circulation unit 160 fixedly installed to the exterior of the tub 120, the air circulation unit 160 serving to heat air and supply the heated air into the tub 120, to realize a drying function of the laundry machine 100.

The cabinet 110 includes a base 118 by which the above constituent elements are supported and seated, and a front panel 111 having an opening 112 for introduction of laundry. In addition, the cabinet 110 includes a left panel 114, a right panel 115, a rear panel 116, and a top panel 117. Here, a door 113 is coupled to the opening 112 of the front panel 111 to open or close the opening 112.

A water supply unit 127 is provided in an upper region of the cabinet 110. The water supply unit 127 includes a water supply hose that supplies water from an external water source into the tub 120, a water supply valve that is installed on the water supply hose to control entrance/exit of water, and a detergent supply device (not shown) that accommodates detergent such that the water supplied through the water supply hose is introduced into the tub 120 along with the detergent. In addition, a drain unit (not shown) is provided in a lower region of the cabinet 110. The drain unit includes a drain hose and a drain pump to discharge wash water used for washing and rinsing from the cabinet 110.

The tub 120, as exemplarily shown in FIG. 4, consists of a front tub 121 constituting a front part and a rear tub 122 constituting a rear part. The front tub 121 and the rear tub 122 are assembled to each other using fasteners, such as screws, etc., and define a space for accommodation of the drum 130 therein.

Here, the front tub 121 has an entrance opening 121*a* that is forwardly adjacent to the door 113 such that laundry may be introduced into the entrance opening 121*a*. The front tub 121 is provided, at an inner circumference thereof defining the entrance opening 121*a*, with a rim portion 121*b* protruding forward of the tub 120. An air discharge port 165 of the air circulation unit 160 that will be described hereinafter is connected to the rim portion 121*b*. A front gasket 124 is provided at the rim portion 121*b* to hermetically seal the rim portion 121*b* and the opening 112 of the front panel 111. The front gasket 124 further functions to prevent foreign substances from entering a space between the tub 120 and the drum 130.

The rear tub 122 has an open rear side. A tub back wall 125 and a rear gasket 126 are provided to close the rear side of the rear tub 122. The rear gasket 126 is connected to both the tub back wall 125 and the rear tub 122 and serves as a seal between the tub back wall 125 and the rear tub 122 to prevent leakage of wash water from the tub 120.

A condensation water supply hole 122*a* is perforated in an outer circumferential surface of the rear tub 120 for generation of condensed water using an inner circumferential surface of the rear tub 120. The inner circumferential surface of the rear tub 120 serves as a condensation surface (not shown) as cold water is supplied thereto through the condensation water supply hole 122*a*. Generation of condensed water using the rear tub 120 will be described herein in detail with regard to the air circulation unit 160.

Here, the tub back wall 125 vibrates along with the drum 130 during rotation of the drum 130. In this case, the tub back wall 125 is spaced from the rear tub 122 by a sufficient interval so as not to interfere with the rear tub 122. The rear gasket 126 is formed of a flexible material located between the tub back wall 125 and the rear tub 122, and allows the tub back wall 125 to move relative to the rear tub 122 without interference. The rear gasket 126 may have a pleated portion that may extend to a sufficient length to permit relative movement between the tub back wall 126 and the rear tub 122 (see FIG. 3).

The tub 120 is vertically supported by support members 118*a* and 118*b* provided at the base 118 of the cabinet 110, and is fixedly mounted using fasteners (for example, screws, or bolts). Additionally, the tub 120 may be secured to the front and rear panels 111 and 116, or the left and right panels 114 and 115 using fasteners (not shown).

The air circulation unit 160 is located above the tub 120 and serves as a unit for circulation and heating of air inside the tub 120 during a drying stroke of the laundry machine 100. That is, the air circulation unit 160 extracts air from the interior of the tub 120 and heats the air to supply the heated air into the tub 120.

To this end, the air circulation unit 160 includes an air return port 161 formed at a lateral position of a circumferential wall of the tub 120 so as to extend in a tangential direction of the tub 120, a blower fan 163 for return movement of the air through the air return port 161, a heating duct 164 for heating of the air moved by the blower fan 163, and the air discharge port 165 to guide the heated air from the heating duct 164 into the tub 120.

Here, the air return port 161 is perforated through the circumferential wall of the tub 120. In addition, a lint filter 162 is attached to an inner surface of the air return port 161 to filter lint that is generated during drying of laundry and moved along the circumferential wall of the tub 120. A filter washing unit 170 that will be described hereinafter is provided inside the air return port 161 (see FIG. 7).

The aforementioned condensation water supply hole 122*a* is located next to the air return port 161. During a drying stroke of the laundry machine 100, cold water is supplied into the condensation water supply hole 122*a* to thereby be moved along the inner circumferential surface (i.e. the condensation surface) of the tub 120. Thereby, as humid air having been used to dry laundry is moved to the air return port 161 simultaneously with the supply of cold water, condensed water is generated on the condensation surface of the tub 120 where the cold water is present. Generation of condensed water using the inner circumferential surface of the tub 120 ensures that condensed water may be generated over a wider area than is obtained using a conventional condensation duct, resulting in more efficient condensation of water.

The blower fan 163 is located at the upper side of the air return port 161. If the blower fan 163 is operated, the air of the tub 120 is introduced into the air return port 161 to thereby be moved to the heating duct 164. The heating duct 164 generates hot air by heating the air moved by the blower fan 163. The air heated in the heating duct 164 is resupplied into the tub 120 through the air discharge port 165 so as to be used to dry laundry.

In the air circulation unit 160 as described above, the lint filter 162 to filter lint contained in the air to be introduced into the air return port 161 requires maintenance/repair management for removal of the filtered lint after the lint filter 162 has been used for a long time.

To this end, the filter washing unit 170 is provided inside the air return port 161. The filter washing unit 170 is adapted to eject wash water toward the lint filter 162 so as to remove the lint filtered by the lint filter 162. A more detailed description of the filter washing unit 170 will follow a description of the configuration of the laundry machine 100.

Other configurations of the laundry machine will be described below with reference to FIGS. 2 and 3.

The drum 130 consists of a front drum 131, a center drum 137, and a rear drum 132, for example. A pair of weight balancers 134 is installed respectively to a front end of the front drum 131 and a rear end of the rear drum 132 and serves to restrict vibration of the drum 130 while the drum 130 is rotated via balancing. In addition, lifters 133 are formed at an inner surface of the center drum 137 to assist movement of laundry.

The rear drum 132 is connected to a spider 136, and in turn the spider 136 is connected to the rotating shaft 135. The drum 130 is rotated within the tub 120 by rotational power transmitted through the rotating shaft 135.

Here, the rotating shaft 135 penetrates the tub back wall 125 and is directly connected to the drive motor 141. More specifically, a rotor of the drive motor 141 is directly connected to the rotating shaft 135. The bearing housing 140 that will be described hereinafter is coupled to a rear surface of the tub back wall 125.

The bearing housing 140 serves to rotatably support the rotating shaft 135 between the drive motor 141 and the tub back wall 125. In addition, the bearing housing 140 is elastically supported by the base 118 with the suspension unit 150 interposed therebetween.

The bearing housing 140 is coupled, at one surface thereof, to the tub back wall 125 that is located at the rear surface of the tub 120. The rotating shaft 135 coupled to the drum 130 penetrates the bearing housing 140. The bearing housing 140 includes a bearing (not shown) to achieve efficient rotation of the rotating shaft 135, and the rotating shaft 135 is supported by the bearing (not shown). In addition, the bearing housing 140 is coupled, at the other surface thereof, to the drive motor 141 that rotates the rotating shaft 135.

Additionally, the bearing housing 140 has a first extension 142 and a second extension 144, which are symmetrically shaped and radially extend in both left and right directions. The first extension 142 and the second extension 144 are coupled to the suspension unit 150, and thus the bearing housing 140 is elastically supported by the suspension unit 150.

Hereinafter, a coupled state of the suspension unit according to the present invention will be described in detail with reference to the accompanying drawings.

Figure 5:
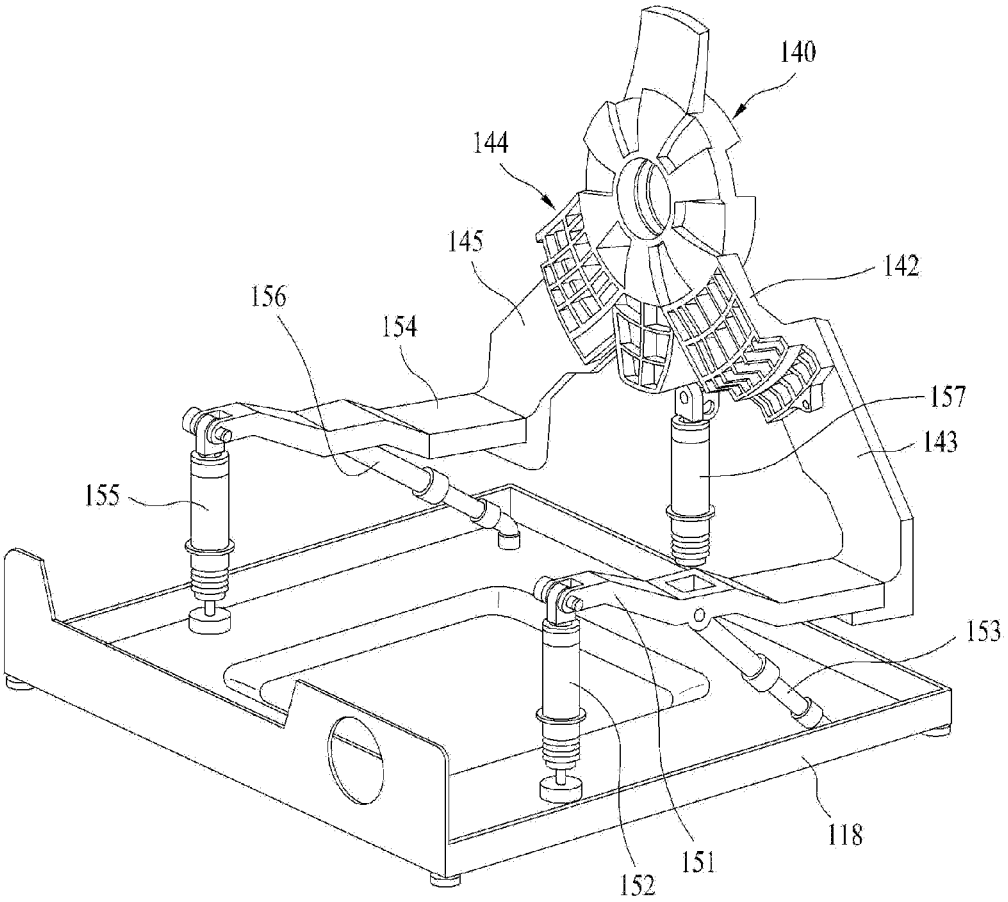
FIG. 5 is a perspective view showing a suspension unit of the laundry machine according to the present invention.
Figure 6:
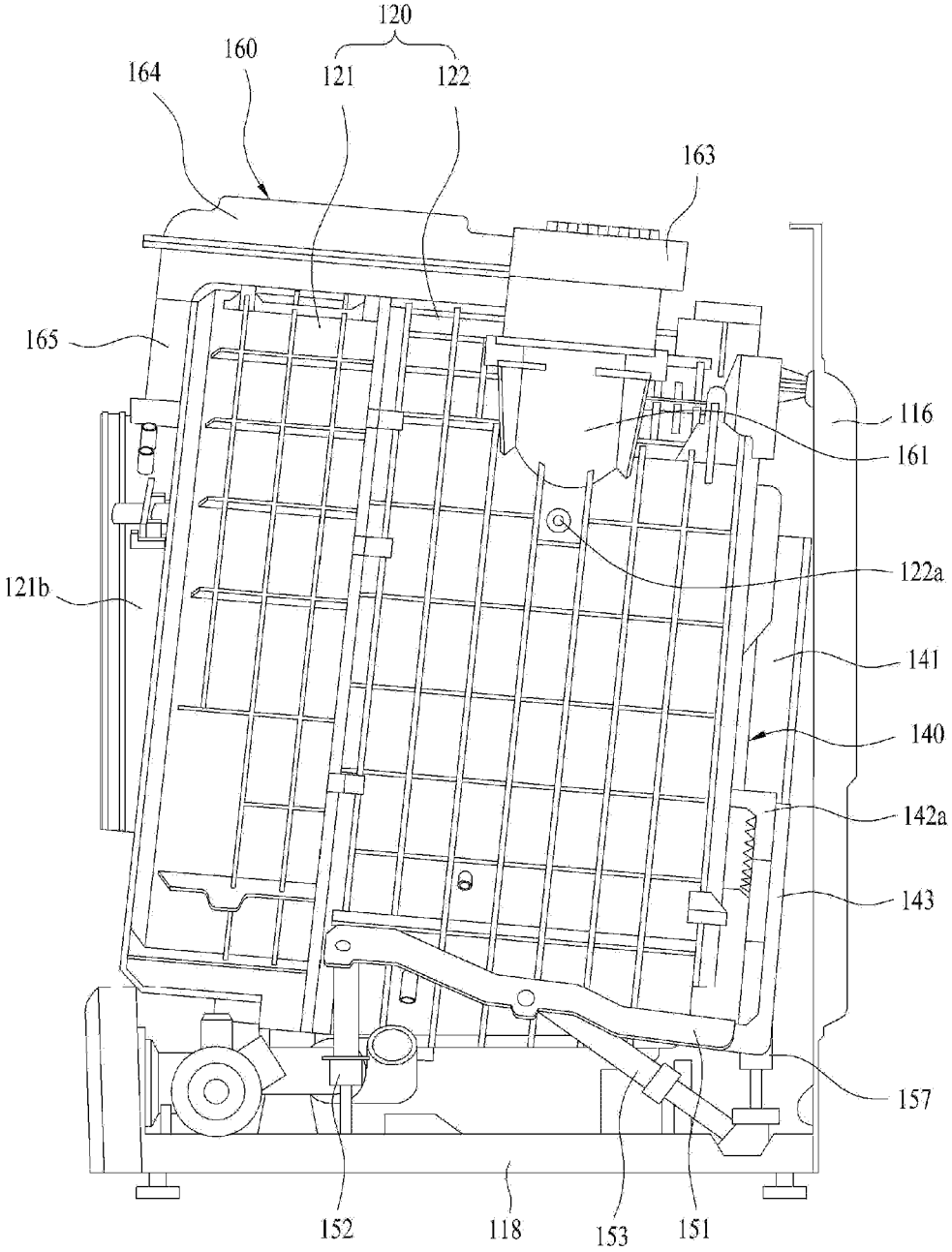
FIG. 6 is a side view showing a coupling relationship of the tub and the suspension unit of the laundry machine according to the present invention.

FIG. 5 is a perspective view showing the suspension unit of the laundry machine according to the present invention, and FIG. 6 is a side view showing a coupling relationship of the tub and the suspension unit of the laundry machine according to the present invention.

The suspension unit 150 includes first and second weights 143 and 145 connected respectively to the first and second extensions 142 and 144, first and second suspension brackets 151 and 154 connected respectively to the first and second weights 143 and 145, first, second and third spring dampers 152, 155 and 157 connected respectively to the first suspension bracket or second suspension bracket 151 or 154 or the bearing housing 140 so as to elastically support the bearing housing 140, and first and second dampers 153 and 156.

The first and second weights 143 and 145 serve to balance a weight of the drum 130 in a state in which laundry is accommodated in the drum 130. In addition, the first and second weights 143 and 145 may serve as damping mass in a vibration system of the drum 130.

The first spring damper 152 is connected between the first suspension bracket 151 and the base 118. In addition, the second spring damper 155 is connected between the second suspension bracket 154 and the base 118. The third spring damper 157 is directly connected between the bearing housing 140 and the base 118. As such, the respective spring dampers 152, 155 and 157 constitute a triangular shock-absorbing support structure having one rear support position and two front support positions.

The first damper 153 is obliquely installed between the first suspension bracket 151 and a rear portion of the base 118, and the second damper 156 is obliquely installed between the second suspension bracket 154 and the rear portion of the base 118.

Preferably, the first and second weights 143 and 145, the first and second suspension brackets 151 and 154, the first and second spring dampers 152 and 155, and the first and second dampers 153 and 156 are symmetrically formed at left and right sides of the rotating shaft of the drum 130. The respective dampers are connected to the base 118 via rubber bushings interposed therebetween so as to be tiltable by a predetermined angle. Thereby, the drum 130 and the bearing housing 140 are supported in a floating manner by the first and second suspension brackets 151 and 154, and the first, second and third spring dampers 152, 155 and 157 within the tub 120.

The drive motor 141 is coupled to a rear surface of the bearing housing 140 and is directly connected to the rotating shaft. The speed of the drive motor 141 is controllable by a controller (not shown). A configuration and kind of the drive motor 141 are well known to those skilled in the art, and various embodiments of the drive motor 141 are possible. Thus, a detailed description thereof will be omitted herein.

Hereinafter, the filter washing unit 170 of the laundry machine 100 according to the present invention will be described in detail with reference to the accompanying drawings.

Figure 7:
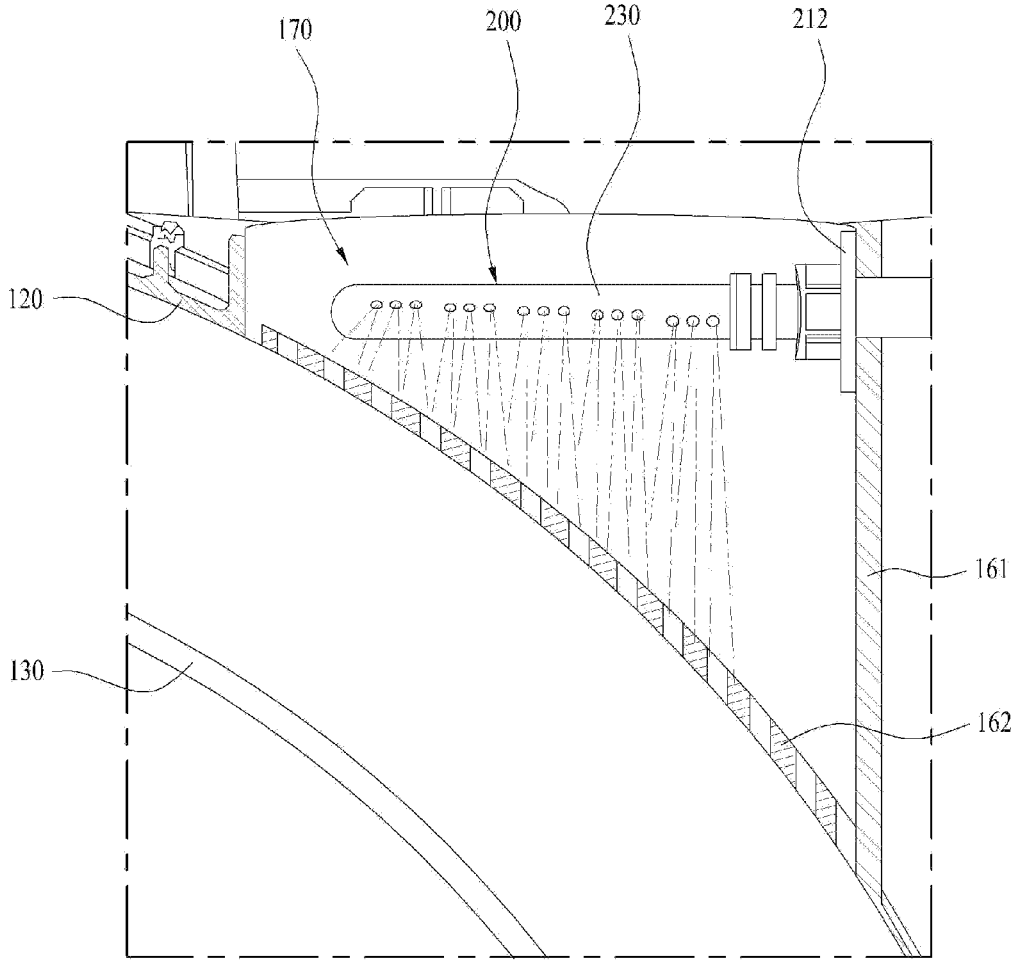
FIG. 7 is a partial sectional view showing a hot air return port and a filter washing unit of the laundry machine according to the present invention.

FIG. 7 is a partial sectional view showing the hot air return port and the filter washing unit of the laundry machine according to the present invention.

The pressure of water to be supplied into the laundry machine 100 may greatly vary according to installation positions of the laundry machine 100. Typically, the laundry machine 100 may be installed such that water is supplied at a pressure of 2.5~4 bars. This pressure range fulfills the supply pressure of water for washing of laundry and the supply pressure of water for washing of the filter, and therefore may ensure a normal operation. However, if an installation position of the laundry machine 100 is unsuitable to achieve a normal water supply pressure and permits the laundry machine 100 to have only the supply pressure of water of 1 bar or less, this may cause an excessively long supply time of wash water, or an insufficient ejection pressure for filter washing, which makes it impossible to realize efficient filter washing.

The laundry machine 100 of the present invention may provide the filter washing unit 170 to efficiently perform filter washing even if the water supply pressure is within a range of 0.3~1 bars. It is noted that the aforementioned pressure range is less than a normal water supply pressure that is selected when supplying water into the laundry machine 100.

As exemplarily shown in FIG. 7, the lint filter 162 to filter lint generated during supply and circulation of hot air for drying of laundry and the filter washing unit 170 to clean the lint filter 162 are provided inside the air return port 161 formed at the outer circumferential surface of the tub 120.

The filter washing unit 170 according to the embodiment of the present invention is located outward of the lint filter 162 and is adapted to inwardly eject wash water at a predetermined pressure, thereby causing the lint filtered by the lint filter 162 to fall inward.

A wash water line 172 for supply of wash water may be connected to the filter washing unit 170 and the filter washing unit 170 may include a distribution nozzle 200 to distribute wash water supplied from the wash water line 172 so as to eject the wash water to the lint filter 162.

Here, the wash water line 172 may diverge from the aforementioned water supply unit 127. The wash water line 172 may supply wash water to the filter washing unit 170 simultaneously with the supply of wash water by the water supply unit 127. Alternatively, a wash water valve 174 may be provided to control the supply of wash water independently of the supply of wash water by the water supply unit 127, such that water for filter washing may be supplied independently of the supply of wash water for washing of laundry. The wash water line 172 laterally penetrates the air return port 161 formed at the tab 120 such that an end of the wash water line 172 is located inside the air return port 161.

The filter washing unit 170 of the present invention may be applied if the laundry machine 100 is installed such that water is supplied at a relatively low pressure (about 0.3~1 bars). On the other hand, if the supply pressure of water is a normal pressure (about 2.5~4 bars) or more, a pressure reduction valve (not shown) may be additionally used.

The distribution nozzle 200 is fixedly mounted inside the air return port 161 and is connected to the wash water line 172. The distribution nozzle 200 will be described hereinafter in detail with reference to FIG. 8.

Figure 8:
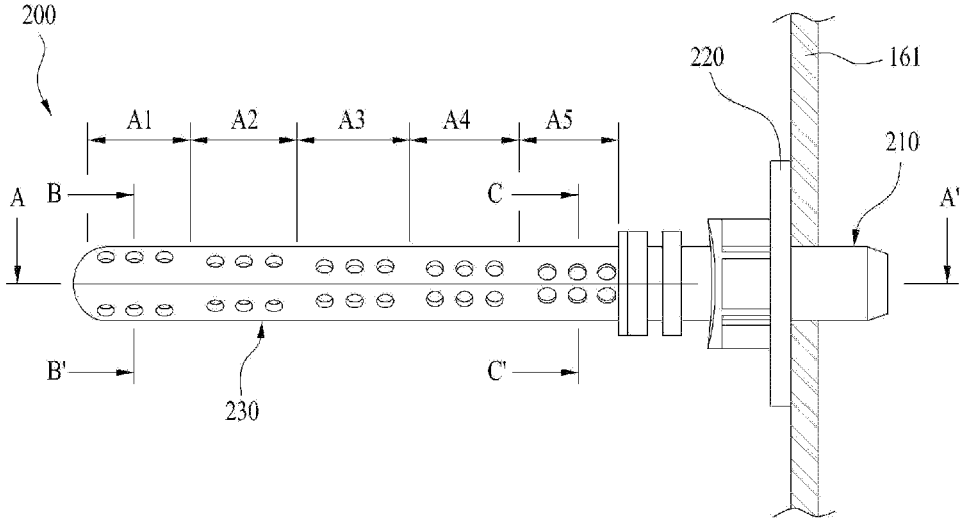
FIG. 8 is a bottom view showing a distribution nozzle of the laundry machine according to the present invention.
Figure 9A:
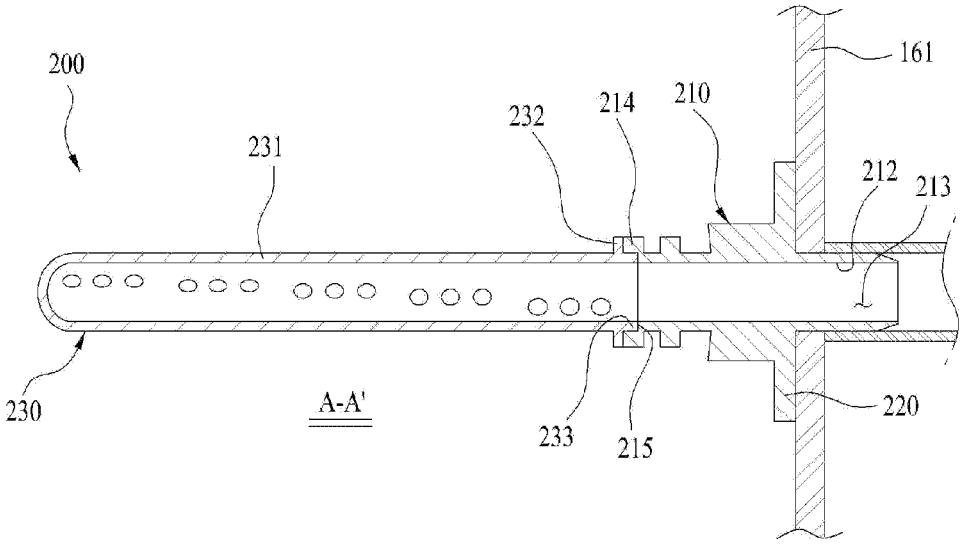
FIGS. 9A to 9C are sectional views showing cross sections of main elements of FIG. 7.
Figure 9B:
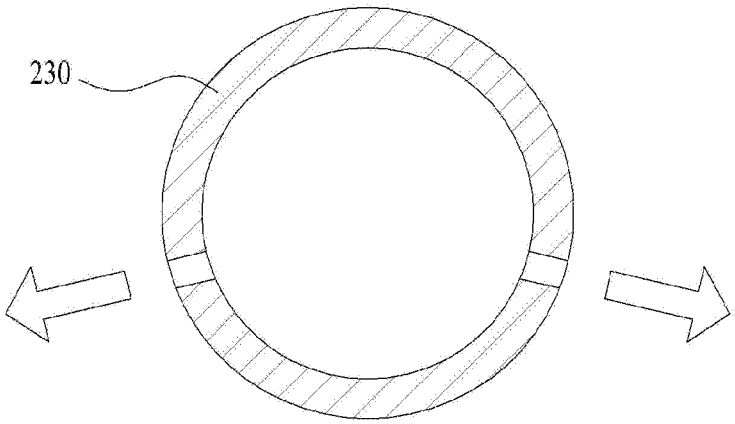
Figure 9C:
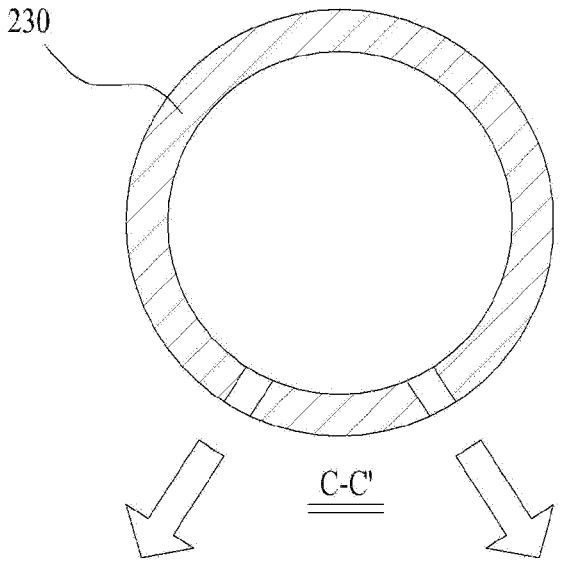

FIG. 8 is a bottom view showing the distribution nozzle of the laundry machine according to the present invention, FIG. 9A is a sectional view taken along the line A-A' of FIG. 8, FIG. 9B is a sectional view taken along the line B-B' of FIG. 8, and FIG. 9C is a sectional view taken along the line C-C' of FIG. 8.

As exemplarily shown in FIGS. 8 and 9A, the distribution nozzle 200, which is fixedly mounted inside the air return port 161, consists of a body part 210, to which the wash water line 172 is connected, and a distribution part 230 coupled to the body part 210, the distribution part 230 having a plurality of nozzle holes (not designated by reference numerals) for ejection of wash water. Here, both the body part 210 and the distribution part 230 are hollowed to internally define bores 213 and 231 respectively.

Considering a configuration of the body part 210, the body part 210 takes the form of a hollow cylinder, one end of which defines a line coupling portion 217 to which the wash water line 172 is connected, and the other end of which defines a front coupling rib 214 to which the distribution part 230 is coupled. In addition, the front coupling rib 214 is provided, at a front surface thereof, with an insertion recess 215, into which an insertion protrusion 233 of the distribution part 230 that will be described hereinafter is inserted. A fixing rib 220 extends between the line coupling portion 217 and the front coupling rib 214. The fixing rib 220 is configured so as to be attached to an inner wall surface of the air return port 161.

The bore 213 defined in the hollow body part 210 provides a passage for wash water. The hollow bore 213 has a diameter of 5~15 mm, and preferably has a diameter of about 9 mm. The diameter of the bore 213 of the body part 210 and the diameter of the bore 231 of the distribution part 230, which will be described hereinafter, are identical.

The distribution part 230, which takes the form of a hollow pipe internally defining the bore 231, has one closed end and the other open end. The open end of the distribution part 230 is provided with a coupling rib 232 that is coupled to the front coupling rib 214 of the body part 210. In addition, the distribution part 230 is longitudinally provided with the plurality of nozzle holes to eject wash water introduced into the bore 231. Here, the plurality of nozzle holes has different angles with respect to a longitudinal center axis of the distribution part 230. In addition, the plurality of nozzle holes is symmetrically formed in a longitudinal direction of the distribution part 230.

Here, if wash water is supplied into the distribution part 230, the wash water introduced into the open end of the distribution part 230 moves to the closed end. The plurality of nozzle holes formed in the distribution part 230 causes the supply pressure of wash water to be reduced as the wash water moves to the closed end of the distribution part 230.

Accordingly, with regard to the distribution part 230, to ensure that wash water distributed by the distribution part 230 is uniformly distributed over the overall surface of the lint filter 162, the diameter of the bore 231, the number of the nozzle holes, the diameter of the nozzle holes, the ejection angle of wash water from the nozzle holes, and a distance between the nozzle holes are very important design factors.

In the present invention, as described above, the bore 231 of the distribution part 230 and the bore 213 of the body part 210 have the same diameter of 5~15 mm. Therefore, the number of the nozzle holes, the diameter of the nozzle holes, the ejection angle of wash water from the nozzle holes, and a distance between the nozzle holes based on the diameter of the bore 231 of the distribution part 230 may be important design factors.

Here, the diameter of the nozzle holes may be within a range of 1~4 mm. Preferably, the diameter of the nozzle holes may be 2 mm. If the diameter of the nozzle holes is relatively large as compared to the diameter of the bore 231 of the distribution part 230, uniform ejection of wash water from the plurality of nozzle holes may be impossible. On the other hand, if the diameter of the nozzle holes is relatively small as compared to the diameter of the bore 231 of the distribution part 230, the distribution part 230 may suffer from increase in internal pressure and difficulties in processing thereof In addition, if the distance between the nozzle holes is relatively small as compared to the diameter of the nozzle holes, interference of wash water ejected from the neighboring nozzle holes may problematically prevent uniform ejection of wash water. Accordingly, it is preferable to maintain a distance of at least 5 mm.

The number of the nozzle holes may be increased or reduced in proportion to an area of the lint filter 162 that is cleaned by the filter washing unit 170. According to design conditions of the aforementioned nozzle holes, a cleaning area on a per nozzle hole basis may be about 9 $cm^2$. In the following description, the area of the lint filter 162 according to the present invention is set to 270 $cm^2$ by way of example.

As such, in the present invention, the number of the nozzle holes formed in the distribution part 230 may be about 30.

Although the respective nozzle holes may be formed to have different ejection angles, the nozzle holes may have different angles on a per specific region basis for ease in manufacture. In the embodiments of the present invention, first to fifth ejection regions A1, A2, A3, A4 and A5 may be provided.

The first ejection region A1 is located adjacent to the closed end of the distribution part 230. The fifth ejection region A5 is located adjacent to the open end of the distribution part 230. The second, third and fourth ejection regions A2, A3 and A4 are located at a uniform interval between the first ejection region A1 and the fifth ejection region A5, and are oriented to have a uniform angle.

At the closed end of the distribution part 230 where the first ejection region A1 is located, the supply pressure of wash water may be minimized. In this case, due to the low supply pressure, the wash water may be ejected from the nozzle holes formed in the first ejection region A1 over a very small ejection distance. Accordingly, the nozzle holes formed in the first ejection region A1 are formed to eject wash water at a slightly higher angle on the basis of the center of the distribution part 230.

In addition, at the open end of the distribution part 230 where the fifth ejection region A5 is located, the supply pressure of wash water may be maximized. In this case, due to the high supply pressure, the wash water may be ejected from the nozzle holes formed in the fifth ejection region A5 over a very long ejection distance. This causes the wash water to be ejected over an unnecessarily wide range. Accordingly, the nozzle holes formed in the fifth ejection region A5 are formed to eject wash water at a slightly lower angle on the basis of the center of the distribution part 230.

The nozzle holes formed in the second, third and fourth ejection regions A2, A3 and A4 may be formed to have different ejection angles than in the first ejection region A1 and the fifth ejection region A5.

Here, the number of the nozzle holes, the diameter of the nozzle holes, and the distance between the nozzle holes as described above may be changed in various ways according to the area of the lint filter 162 to be cleaned. Accordingly, the number of the nozzle holes, the diameter of the nozzle holes, and the distance between the nozzle holes according to the present invention are not limited to the above description. In addition, although the first to fifth ejection regions A1, A2, A3, A4 and A5 have been described herein, the ejection regions are not limited thereto and may be increased or reduced in number according to the area of the lint filter 162 and the length of the distribution part 230.

Figure 10:
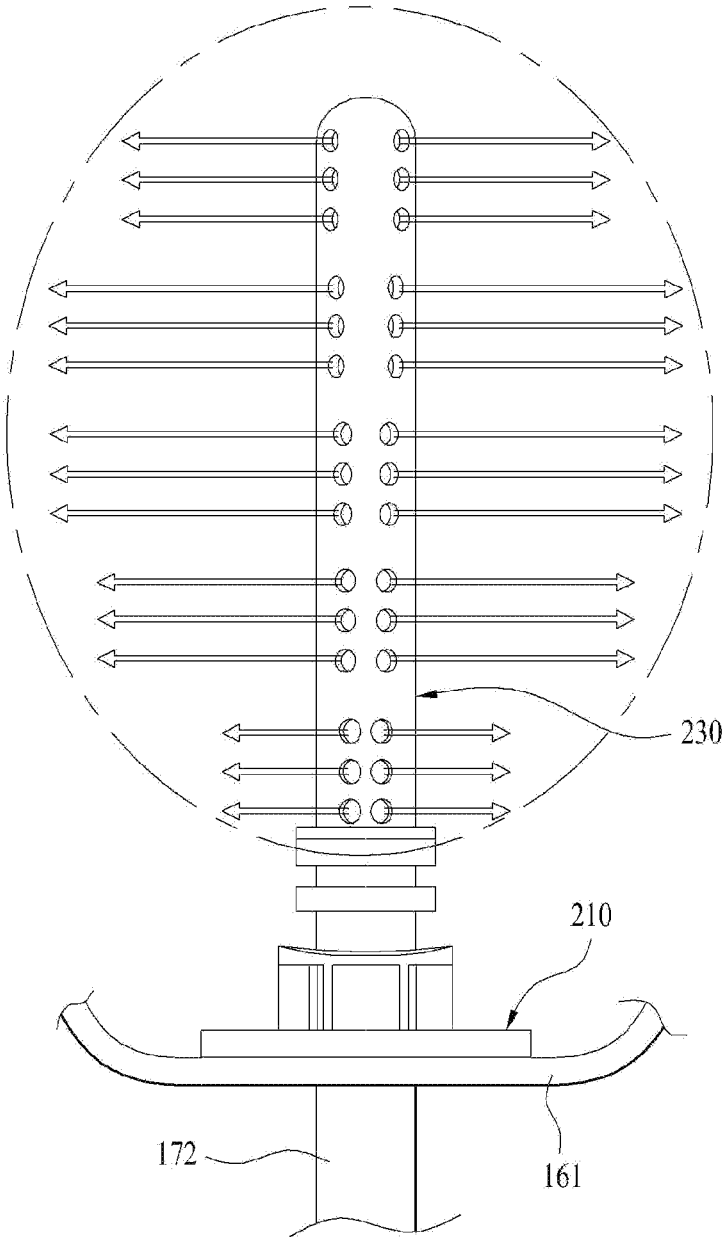
FIG. 10 is a view showing the concept of ejection from the distribution nozzle of the laundry machine according to the present invention.

Operations of the aforementioned distribution nozzle will be described hereinafter in detail with reference to the accompanying drawings. FIG. 10 is a view showing the concept of ejection from the distribution nozzle of the laundry machine according to the present invention.

As exemplarily shown in FIG. 10, in the filter washing unit 170 according to the present invention, wash water supplied through the wash water supply line 172 is directed through the bore 213 of the body part 210 and the bore 231 of the distribution part 230. While passing through the bore 231 of the distribution part 230, the wash water is ejected to the lint filter 162 through the nozzle holes formed in the first to fifth ejection regions A1, A2, A3, A4 and A5.

In this case, the wash water ejected from the distribution part 230 is used to wash the lint filter 162 as the wash water is ejected over the overall area of the lint filter 162 according to the diameter, the number, and the ejection angle of the nozzle holes formed in the first to fifth ejection regions A1, A2, A3, A4 and A5.

Figure 11:
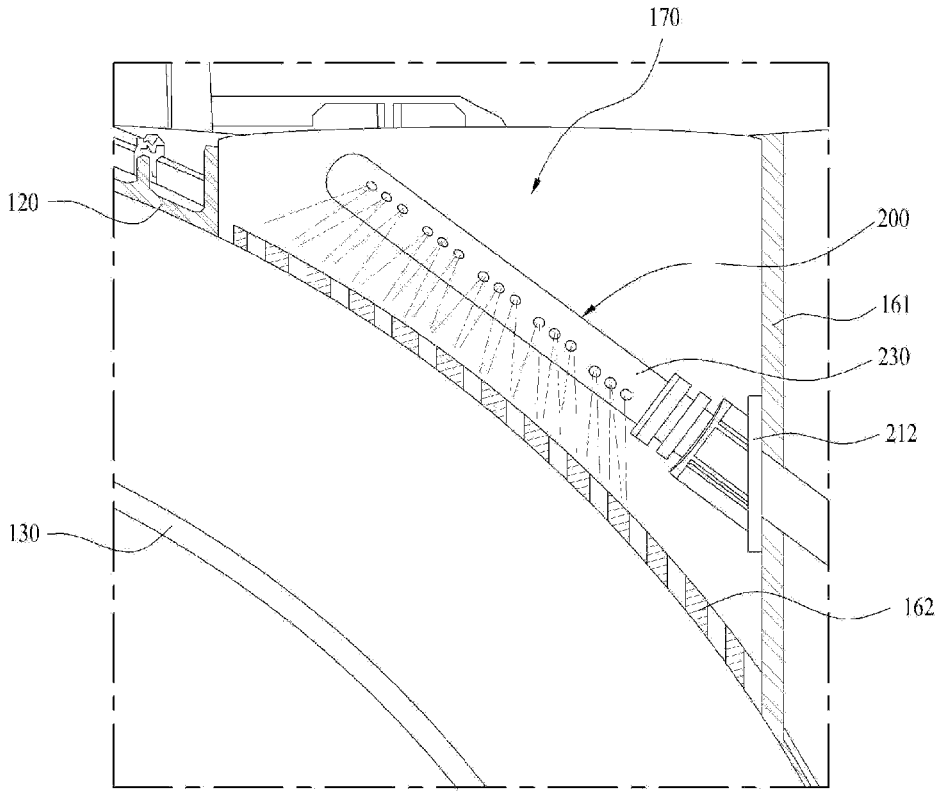
FIG. 11 is a sectional view showing another installation example of the distribution nozzle of the laundry machine according to the present invention.

Meanwhile, the distribution nozzle 200 of the filter washing unit 170 as described above may be horizontally installed regardless of an installation direction of the lint filter 162. Alternatively, the distribution nozzle 200 may be installed parallel to the installation direction of the lint filter 162. Additionally, if the lint filter 162 is formed to extend along the outer circumferential surface of the tub 120 according to the present invention, the distribution nozzle 200 of the filter washing unit 170 may be installed parallel to a tangential direction of a central portion of the lint filter 162 (see FIG. 11).

Hereinafter, a washing procedure of the lint filter 162 using the filter washing unit 170 of the laundry machine 100 as described above according to the present invention will be described in detail with reference to the accompanying drawings.

Figure 12:
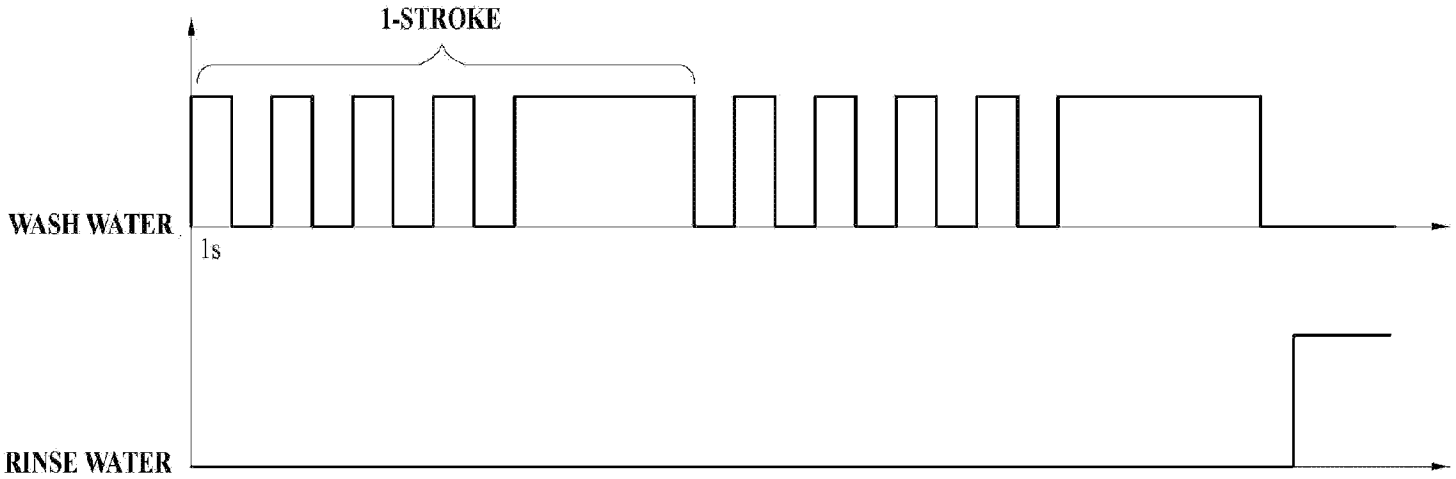
FIG. 12 is a graph showing a washing procedure of a lint filter washing method during rinsing of the laundry machine according to the present invention.
Figure 13:
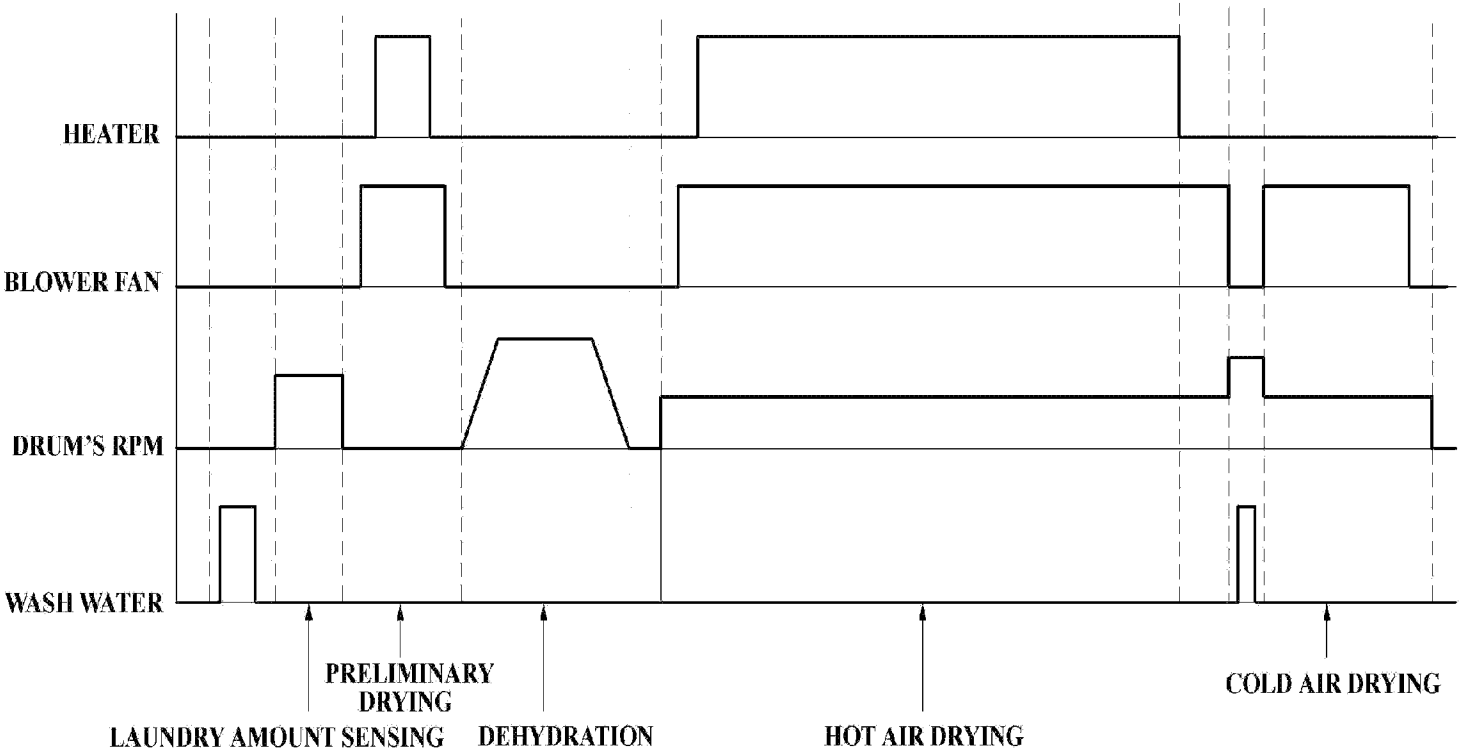
FIG. 13 is a graph showing a washing procedure of the lint filter washing method during drying of the laundry machine according to the present invention.

FIG. 12 is a graph showing a washing procedure of a lint filter washing method during rinsing of the laundry machine 100 according to the present invention, and FIG. 13 is a graph showing a washing procedure of a lint filter washing method during drying of the laundry machine 100 according to the present invention.

In the following description, the present invention relates to a washing procedure of the lint filter 162. Thus, a detailed description of washing, rinsing, and drying procedures of the laundry machine 100 will be omitted.

Hereinafter, a lint filter washing method according to one embodiment of the present invention will be described with reference to FIG. 12. The lint filter washing method according to one embodiment of the present invention is performed during rinsing of laundry.

More specifically, removal of lint filtered by the lint filter 162 may be performed prior to rinsing of laundry. This is because the lint separated from the lint filter 162 via cleaning of the lint filter 162 may be discharged along with rinse water for rinsing of laundry.

Meanwhile, to clean the lint filter 162 prior to initiating a rinsing procedure, a wash water valve (not shown) is opened to supply wash water into the filter washing unit 170. In this case, through provision of the wash water valve, the wash water supplied into the filter washing unit 170 is intermittently supplied for a predetermined time, and then is continuously supplied for a predetermined time.

Here, the reason why the wash water is intermittently supplied is that if the pressure of wash water is relatively low (about 0.3~1 bars), intermittent supply of wash water causes a temporarily higher ejection pressure of wash water than that in continuous supply of wash water.

That is, in the case in which the supply of wash water is controlled by the wash water valve, the pressure of wash water is temporarily increased if the wash water valve is closed, such that the wash water is intermittently supplied at an increased pressure. This allows the wash water supplied from the filter washing unit 170 to be ejected at a slightly higher pressure than the supply pressure of wash water.

Meanwhile, the wash water to be supplied into the filter washing unit 170 as described above may be intermittently supplied at an interval of about 1 second. That is, the wash water valve may be opened to supply wash water for 1 second, and closed to stop the supply of wash water for 1 second. This valve closing/opening operation is iterated four or five times. The operation of intermittently supplying wash water is referred to as 'intermittent supply'.

After completing the intermittent supply of wash water as described above, the wash water valve is opened for a predetermined time so as to continuously supply wash water. In this case, a time for which the wash water is continuously supplied is about 3~5 seconds. Here, the operation of continuously supplying wash water is referred to as 'continuous supply'.

The aforementioned intermittent supply serves to apply shock to lint adhered to the lint filter 162 so as to provide the lint with mobility. The aforementioned continuous supply serves to separate the lint having mobility from the lint filter 162.

Meanwhile, the aforementioned intermittent supply and continuous supply are sequentially performed. Performing each of the intermittent supply and the continuous supply one time is referred to as a 'washing stroke'.

The washing stroke may be performed plural times prior to initiating rinsing of laundry. Then, after completion of the washing stroke, rinse water is supplied to perform rinsing of laundry. Here, the washing stroke before rinsing of laundry may be performed about two or three times, and preferably may be performed two times.

The aforementioned washing stroke is not performed simultaneously with the supply of rinse water. That is, if the supply of wash water is performed simultaneously with the supply of rinse water in a state in which the supply pressure of wash water is lower than a general supply pressure, this may cause the supply pressure of wash water to be further reduced. Meanwhile, the amount of rinse water to be supplied during rinsing of laundry is equal to the amount of rinse water except for the amount of wash water supplied for filter washing.

Hereinafter, a lint filter washing method according to another embodiment of the present invention will be described with reference to FIG. 13. The lint filter washing method according to the present embodiment is performed for a drying stroke of laundry.

As exemplarily shown in FIG. 13, as the drying stroke is initiated, 'laundry amount sensing' in which the amount of laundry accommodated in the drum 130 is sensed during rotation of the drum 130 is performed. After the amount of laundry is sensed, the blower fan 163 and the heater of the air circulation unit 160 are sequentially actuated to perform 'preliminary drying' in which the laundry accommodated in the drum 130 is preheated for a predetermined time.

Then, after preliminary drying of laundry is completed, 'dehydration' is performed as the drive motor 141 is driven to rotate the drum 130. Then, after the dehydration is completed, the blower fan 163, the heater and the drive motor 141 are actuated to perform 'hot air drying'. After the hot air drying is completed, cold air is supplied as actuation of the heater stops and the blower fan 163 and the drum 130 are rotated. Thereby, 'cold air drying' is performed as the laundry heated during the hot air drying is cooled by the cold air.

Meanwhile, a procedure of washing the lint filtered by the lint filter 162 is performed before and during the aforementioned drying stroke. Specifically, a first washing procedure in which the lint filter 162 is washed before the amount of laundry is sensed during the drying stroke and a second washing procedure in which the lint filter 162 is washed after completion of the hot air drying and before the cold air drying are performed.

More specifically, the first washing procedure serves to remove the lint filtered by the lint filter 162 so as to ensure efficient circulation of air during the drying stroke. In the first washing procedure, first, the wash water valve (not shown) is opened to supply wash water into the filter washing unit 170. In this case, through provision of the wash water valve, the supply of wash water into the filter washing unit 170 is intermittently performed for a predetermined time, and then is continuously performed for a predetermined time.

Here, the reason why the wash water is intermittently supplied is that if the pressure of wash water is relatively low (about 0.3~1 bars), intermittent supply of wash water causes a temporarily higher ejection pressure of wash water than that in continuously supply of wash water.

That is, in the case in which the supply of wash water is controlled by the wash water valve, the pressure of wash water is temporarily increased if the wash water valve is closed, such that the wash water is intermittently supplied at an increased pressure. This allows the wash water supplied from the filter washing unit 170 to be ejected at a slightly higher pressure than the supply pressure of wash water.

Meanwhile, the wash water to be supplied into the filter washing unit 170 as described above may be intermittently supplied at an interval of about 1 second. That is, the wash water valve may be opened to supply wash water for 1 second, and closed to stop the supply of wash water for 1 second. This valve closing/opening operation is iterated four or five times. The operation of intermittently supplying wash water is referred to as 'intermittent supply'.

After completing the intermittent supply of wash water as described above, the wash water valve is opened for a predetermined time so as to continuously supply wash water. In this case, a time for which the wash water is continuously supplied is about 3~5 seconds. Here, the operation of continuously supplying wash water is referred to as 'continuous supply'.

The aforementioned intermittent supply serves to apply shock to lint adhered to the lint filter 162 so as to provide the lint with mobility. The aforementioned continuous supply serves to separate the lint having mobility from the lint filter 162.

Meanwhile, the aforementioned intermittent supply and continuous supply are sequentially performed. Performing each of the intermittent supply and the continuous supply one time is referred to as a 'washing stroke'.

The first washing procedure is performed prior to initiating rinsing of laundry. Here, the first washing procedure before rinsing of laundry may be performed about two or three times, and preferably may be performed two times.

Additionally, the second washing procedure of washing the lint filter 162 after completion of the hot air drying and before initiation of the cold air drying will be described hereinafter. The second washing procedure serves to prevent the lint filtered by the lint filter 162 from adhering to the lint filter 162 during the drying stroke. Meanwhile, the filtered lint is not yet adhered to the lint filter 162 during the hot air drying, and therefore the second washing procedure does not require the intermittent supply of wash water and the continuous supply of wash water differently from the first washing procedure. In the second washing procedure, only wash water required to separate the unadhered lint from the lint filter 162 may be supplied. The wash water supplied during the second washing procedure may be intermittently supplied. However, preferably, the wash water is supplied only once for 1 second.

The lint filter washing method of the present invention as described above enables easy removal of lint adhered to the lint filter even at a low water supply pressure.

The distribution nozzle of the present invention as described above enables easy removal of lint adhered to the lint filter even at a low water supply pressure by ejecting wash water over a wide area.

Although embodiments have been described in detail with reference to a number of illustrative embodiments thereof, it should be understood that numerous other modifications and embodiments can be devised by those skilled in the art that will fall within the spirit and scope of the principles of this disclosure. Accordingly, it is intended that the present invention covers the modifications and variations of this invention provided they come within the scope of the appended claims and their equivalents.

The invention claimed is:

1. A method of washing a lint filter of a laundry machine, the laundry machine comprising a wash water line configured to supply wash water, a wash water valve configured to open or close the wash water line, and a filter washing unit configured to eject the wash water to the lint filter so as to clean the lint filter, the method comprising a washing stroke including intermittent supply of the wash water under control of the wash water valve, wherein the washing stroke is performed before a rinsing stroke or a drying stroke of the laundry machine, and wherein the drying stroke includes:

sensing an amount of laundry;

preliminarily drying the laundry by supplying hot air in a state in which the laundry is stationary;

dehydrating the laundry;

drying the laundry by supplying hot air while moving the laundry; and drying the laundry by supplying cold air while moving the laundry.

2. The method according to claim 1, wherein the washing stroke is performed before the sensing of the amount of laundry, or between the hot air drying and the cold air drying.

3. The method according to claim 1, wherein the intermittent supply of wash water includes intermittently ejecting the wash water for 1 to 2 seconds at an interval of 1 to 2 seconds.

* * * * *